US005644956A

United States Patent [19]

Blackman et al.

[11] Patent Number: 5,644,956

[45] Date of Patent: Jul. 8, 1997

[54] ROTARY DRILL BIT WITH IMPROVED CUTTER AND METHOD OF MANUFACTURING SAME

[75] Inventors: Mark Philip Blackman, Lewisville; Jay Stuart Bird, Waxahachie; Michael Steve Beaton, Cedar Hill, all of Tex.

[73] Assignee: Dresser Industries, Inc., Dallas, Tex.

[21] Appl. No.: 454,936

[22] Filed: May 31, 1995

Related U.S. Application Data

[62] Division of Ser. No. 221,371, Mar. 31, 1994, Pat. No. 5,429,200.

[51] Int. Cl.[6] ..... B21K 5/02; F21B 10/08

[52] U.S. Cl. ..... 76/108.2; 175/371; 175/432; 175/434

[58] Field of Search ..... 76/108.1, 108.2; 175/371–374, 432, 434

[56] References Cited

U.S. PATENT DOCUMENTS

| | | | |
|---|---|---|---|
| 2,234,197 | 3/1941 | Reed | 175/375 |
| 2,907,551 | 10/1959 | Peter . | |
| 2,939,684 | 6/1960 | Payne . | |
| 3,389,761 | 6/1968 | Ott | 175/374 |
| 3,497,942 | 3/1970 | Weiss | 29/470.3 |
| 3,888,405 | 6/1975 | Jones, et al. | 228/2 |
| 3,990,525 | 11/1976 | Penny | 175/337 |
| 4,037,673 | 7/1977 | Justman | 175/371 |
| 4,054,426 | 10/1977 | White | 51/309 |
| 4,067,490 | 1/1978 | Jones, et al. | 228/102 |
| 4,098,150 | 7/1978 | Penny et al. | 76/108.2 |
| 4,098,358 | 7/1978 | Klima | 175/65 |
| 4,102,419 | 7/1978 | Klima | 384/94 X |
| 4,249,622 | 2/1981 | Dysart | 175/227 |
| 4,280,571 | 7/1981 | Fuller | 175/337 |
| 4,398,952 | 8/1983 | Drake | 419/18 |
| 4,562,892 | 1/1986 | Ecer | 175/371 |
| 4,593,776 | 6/1986 | Salesky et al. | 175/375 |
| 4,597,456 | 7/1986 | Ecer | 175/371 |
| 4,630,692 | 12/1986 | Ecer | 175/374 X |
| 4,679,640 | 7/1987 | Crawford | 175/374 |

(List continued on next page.)

OTHER PUBLICATIONS

Rock Bits Diamond Products Drilling Tools, Security Oilfield Catalog, 40 pages (undated).

Security Sales Literature, A Totally New Rock Bit Bearing System, 10 pages (undated)—cited in parent case and copy in that file history.

*Primary Examiner*—Douglas D. Watts

*Attorney, Agent, or Firm*—Baker & Botts, L.L.P.

[57] ABSTRACT

A rotary cone drill bit for forming a borehole having a body with an underside and an upper end portion adapted for connection to a drill string. The drill bit rotates around a central axis of the body. A number of angularly-spaced arms are integrally formed with the body and depend therefrom. Each arm has an inside surface with a spindle connected thereto and an outer shirttail surface. Each spindle projects generally downwardly and inwardly with respect to its associated arm, has a generally cylindrical upper end portion connected to the associated inside surface, and has an inner sealing surface on the upper end portion. A number of rotary cone cutters equal to the number of arms are each mounted on respective spindles. Each of the cutters includes an internal generally cylindrical wall defining a cavity for receiving the respective spindle, a gap with a generally cylindrical portion defined between the spindle and cavity wall, an outer sealing surface in the cavity wall concentric with the inner sealing surface, and a seal element spanning the gap and sealing between the inner and outer sealing surfaces. The gap includes an opening contiguous with and directed outwardly from the shirttail surface. A shirttail tip may be included to form a generally planar second portion of the gap defined between the inside surface and the cutter, the second portion substantially perpendicular to the first portion. The rotary cone cutters are preferably composites formed from different types of material.

19 Claims, 6 Drawing Sheets

U.S. PATENT DOCUMENTS

| | | | |
|---|---|---|---|
| 4,688,651 | 8/1987 | Dysart | 175/371 |
| 4,726,432 | 2/1988 | Scott et al. | 175/375 |
| 4,814,254 | 3/1989 | Naito et al. | 430/203 |
| 4,938,991 | 7/1990 | Bird | 427/190 |
| 5,131,480 | 7/1992 | Lockstedt et al. | 175/374 |
| 5,279,374 | 1/1994 | Sievers et al. | 175/374 |
| 5,341,890 | 8/1994 | Cawhorne et al. | 175/374 |
| 5,348,770 | 9/1994 | Sievers et al. | 175/374 X |

ROTARY DRILL BIT WITH IMPROVED CUTTER AND METHOD OF MANUFACTURING SAME

This application is a divisional application of U.S. application Ser. No. 08/221,371, filed Mar. 31, 1994 and entitled "Rotary Drill Bit with Improved Cutter" (as amended), now U.S. Pat. No. 5,429,200.

RELATED APPLICATION

This application is related to copending application entitled Rotary Drill Bit with Improved Cutter and Seal Protection, Ser. No. 08,221,841, filed Mar. 31, 1994.

TECHNICAL FIELD OF THE INVENTION

This invention relates in general to rotary cone drill bits used in drilling a borehole in the earth and in particular to composite cone cutters with enhanced downhole performance.

BACKGROUND OF THE INVENTION

One type of drill used in forming a borehole in the earth is a roller cone bit. A typical roller cone bit comprises a body with an upper end adapted for connection to a drill string. Depending from the lower end portion of the body are a plurality of arms, typically three, each with a spindle protruding radially inward and downward with respect to a projected rotational axis of the body. A cone cutter is mounted on each spindle and supported rotatably on bearings acting between the spindle and the inside of a spindle-receiving cavity in the cutter. On the underside of the body and radially inward of the arms are one or more nozzles. These nozzles are positioned to direct drilling fluid passing downwardly from the drill string toward the bottom of the borehole being formed. The drilling fluid washes away the material removed from the bottom of the borehole and cleanses the cutters, carrying the cuttings radially outward and then upward within the annulus defined between the bit body and the wall of the borehole.

Protection of the bearings which allow rotation of the respective roller cone cutters can lengthen the useful service life of the bit. Once drilling debris is allowed to infiltrate between the bearing surfaces of the cone and spindle, failure of the bearing and the drill bit will follow shortly. Various mechanisms have been employed to help keep debris from entering between the bearing surfaces. A typical approach is to utilize an elastomeric seal across the gap between the bearing surfaces of the rotating cone cutter and its support on the bit. However, once the seal fails, it again is not long before drilling debris contaminates the bearing surfaces via the gap between the rotating cutter and the spindle. Thus, it is important that the seal be fully protected against wear caused by debris in the borehole.

At least two prior art approaches have been employed to protect the seal from debris in the well. One approach is to provide hardfacing and wear buttons on opposite sides of the gap between the spindle support arm and cutter, respectively, where the gap opens to the outside of the bit and is exposed to debris-carrying well fluid. These buttons slow the erosion of the metal adjacent the gap, and thus prolong the time before the seal is exposed to borehole debris. Another approach is to construct the inner-fitting parts of the cutter and the spindle support arm so as to produce in the gap a tortuous path to the seal that is difficult for debris to follow. An example of this latter arrangement is disclosed in U.S. Pat. No. 4,037,673.

An example of the first approach is used in a conventional tri-cone drill bit wherein the base of each cone cutter at the juncture of the respective spindle and support arm is defined at least in part by a substantially frustoconical surface, termed the cone backface. This cone backface is slanted in the opposite direction as the conical surface of the shell or tip of the cutter and includes a plurality of hard metal buttons or surface compacts. The latter are designed to reduce the wear of the frustoconical portion of the backface on the cone side of the gap. On the other side of the gap, the tip of the arm is protected by a hardfacing material. For definitional purposes, that portion of the arm which is on the outside of the bit and below the nozzle is referred to as a shirttail surface or simply shirttail. More specifically, in referring to prior art bits, radially outward of the juncture of the spindle with the arm, and toward the outer side of the bit, the lower pointed portion of the shirttail is referred to as the tip of the shirttail or shirttail tip.

During drilling with rotary bits of the foregoing character, debris often collects between the backface of the cone cutters and the wall of the borehole generally within the area where the respective gaps associated with each cone cutter open to the borehole annulus. As a result, the underside of the edge of the shirttail tips which lead in the direction of rotation of the bit during drilling, i.e., the leading edge, can become eroded. As this erosion progresses, the hardfacing covering the shirttail tips eventually chips off. This chipping exposes underlying softer metal to erosion and thereby shortens the path that debris may take through the gap to the seal. This path shortening ultimately exposes the seal to borehole debris and thereby causes seal failure.

SUMMARY OF THE INVENTION

The present invention contemplates an improved rotary cone drill bit by novel construction of the interfitting relationship between the associated cone cutters and their respective support arms to better protect against erosion at the clearance gap between each cone cutter and its respective arm and, thereby, better protect seals disposed in the gap associated with each cone cutter. The present invention also includes a composite cone cutter with improved wearing surfaces and enhanced service life.

In one aspect of the invention, a support arm and cone cutter assembly of a rotary rock bit having a body provides superior erosion protection. The assembly includes an arm integrally formed with the body and having an inner surface, a shirttail surface, and a bottom edge. The inner surface and the shirttail surface are contiguous at the bottom edge. A spindle is attached to the inner surface and is angled downwardly with respect to the arm. A portion of the spindle defines an inner sealing surface. The assembly also includes a cutter that defines a cavity with an opening for receiving the spindle. A portion of the cavity defines an outer sealing surface that is concentric with the inner sealing surface. The assembly further includes a seal for forming a fluid barrier between the inner and outer sealing surfaces. A gap associated with each support arm and cone cutter assembly includes a portion formed between the respective cavity and spindle, and has an opening contiguous with the bottom edge of the respective support arm.

In another aspect of the invention, a composite cone cutter is provided with the backface of the cone having a hard metal covering such as hardfacing. Alternatively, a portion of the composite cone including the backface may itself be made of hard metal so that the base of the composite cone adjacent the gap is highly resistant to both erosion and wear.

In accomplishing this, an important and preferred aspect of the invention is the formation of a composite cone cutter for a rotary cone drill bit which is comprised of dissimilar materials normally incompatible with each other under the usual processing steps required for the manufacture of a rotary cone drill bit. Specifically, the cone backface may be formed of a hard metal material that is more resistant to erosion and wear than conventional hardfacing materials and also incompatible with the usual heat-treating processes to which the main portion or shell of the cone body is subjected.

The invention also resides in the novel construction of the body of the cone cutter with the separate formation of a base portion comprised of a nonheat-treatable material and a conical tip or shell comprised of a conventional heat-treated steel. Subsequently, the base and tip are joined securely together in a manner which is non-destructive to the heat-treated characteristics of the tip and the high hardness characteristics of the base. The present invention results in a composite cone cutter having metallurgical characteristics which optimize downhole performance while at the same time allowing for reliable, efficient manufacturing of the composite cone cutter.

An important technical advantage of the present invention includes the ability to fabricate or manufacture a backface ring separately from the shell or tip of the cone cutter body. Thus, various types of wear buttons, inserts, and/or compacts may be fabricated as an integral part of the backface ring during the associated molding or casting process. Also, fabrication of the backface ring as a separate component allows molding a layer of diamonds and/or diamond particles as an integral part of the backface ring. The present invention allows designing and fabrication of a backface ring which will optimize the downhole performance of the associated cone cutter without affecting the performance of the shell or tip of the cone cutter body.

The foregoing and other advantages of the present invention will become more apparent from the following description of the preferred embodiments for carrying out the invention when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
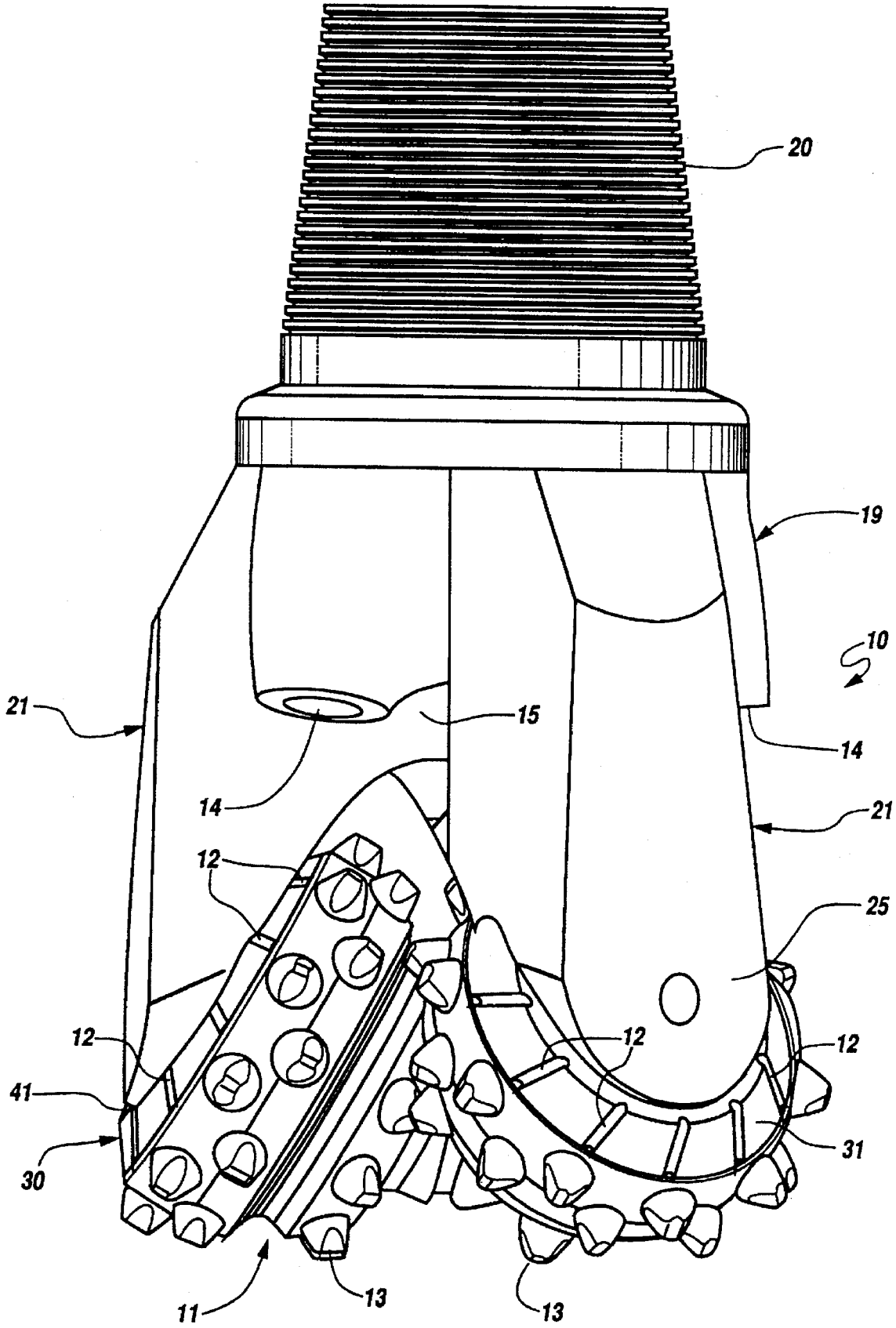
FIG. 1 is an isometric view of a rotary cone drill bit embodying the novel features of the present invention.

The preferred embodiments of the present invention and its advantages are best understood by referring to FIGS. 1–4D of the drawings, like numerals being used for like and corresponding parts of the various drawings.

As shown in the drawings for purposes of illustration, the present invention is embodied in a rotary cone drill bit 10 of the type utilized in drilling a borehole in the earth. Rotary cone drill bit 10 may sometimes be referred to as a "rotary rock bit." With rotary cone drill bit 10, cutting action occurs as cone-shaped cutters 11 are rolled around the bottom of the borehole by rotation of a drill string (not shown) attached to bit 10. Cutters 11 may sometimes be referred to as "rotary cone cutters" or "roller cone cutters."

As shown in FIG. 1, cutters 11 each include cutting edges formed by grooves 12 and protruding inserts 13 which scrape and gouge against the sides and bottom of the borehole under the weight applied through the drill string. The formation of material debris thus created is carried away from the bottom of the borehole by drilling fluid ejected from nozzles 14 on underside 15 of bit 10. The debris-carrying fluid generally flows radially outward between underside 15 or exterior of bit 10 and the borehole bottom, and then flows upwardly toward the well head (not shown) through an annulus 16 (FIG. 3) defined between bit 10 and side wall 17 of the borehole.

As shown in FIG. 1, rotary cone drill bit 10 comprises an enlarged body 19 with a tapered, externally-threaded upper section 20 adapted to be secured to the lower end of the drill string. Depending from the body are three support arms 21 (two visible in FIG. 1), each with a spindle 23 (FIGS. 2 and 3) connected to and extending from an inside surface 24 thereof and a shirttail outer surface 25. Spindles 23 are preferably angled downwardly and inwardly with respect to bit body 19 so that as bit 10 is rotated, the exterior of cutters 11 engage the bottom of the borehole. For some applications, spindles 23 may also be tilted at an angle of zero to three or four degrees in the direction of rotation of drill bit 10.

Within the scope of the present invention, each of three cutters 11 is constructed and mounted on its associated spindle 23 in a substantially identical manner (except for the pattern of the rows of inserts 13). Accordingly, only one of arm 21/cutter 11 assemblies is described in detail, it being appreciated that such description applies also to the other two arm-cutter assemblies.

Figure 2:
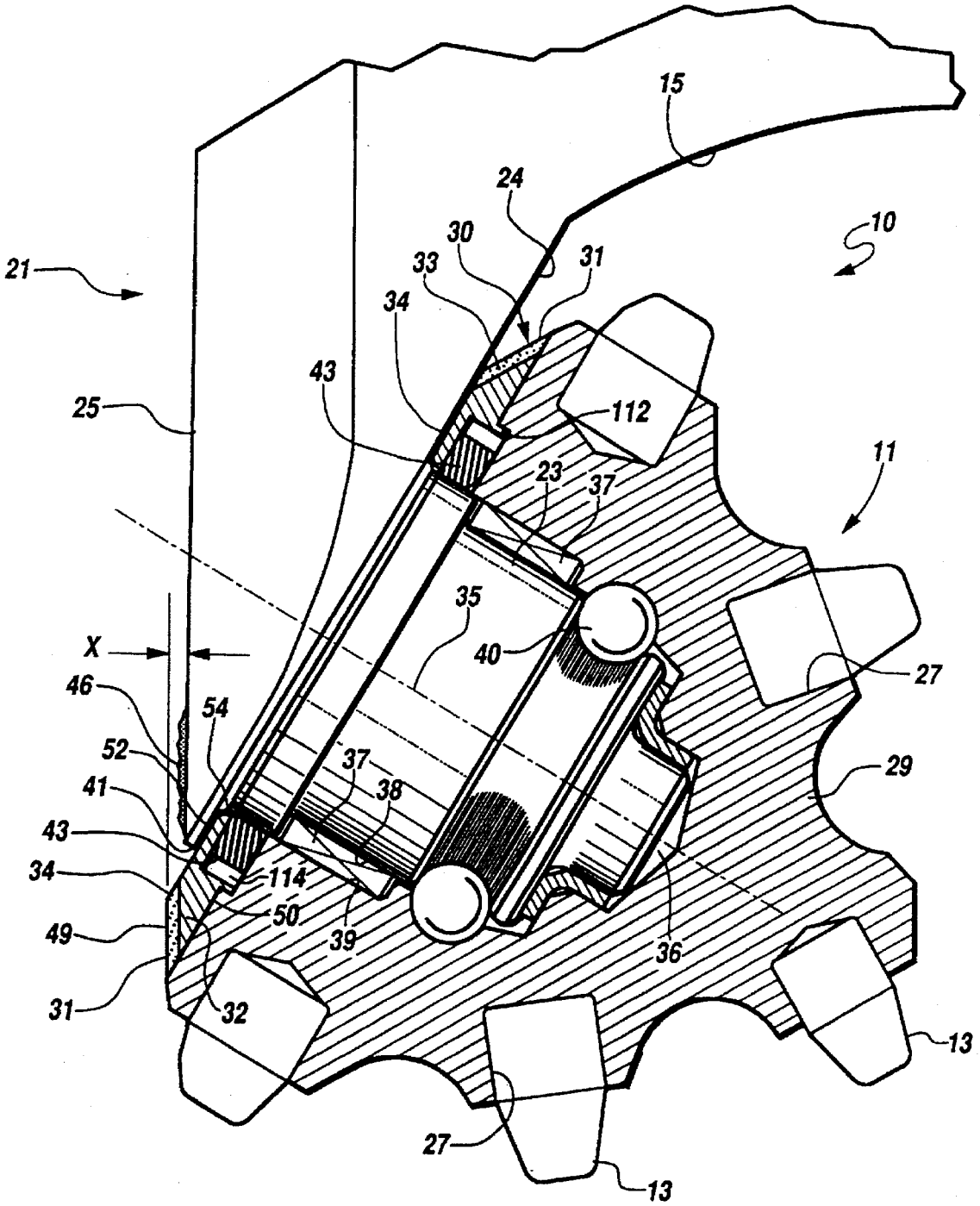
FIG. 2 is an enlarged drawing partially in section and partially in elevation with portions broken away showing one of the rotary cone cutters mounted on a support arm of the drill bit illustrated in FIG. 1.
Figure 2A:
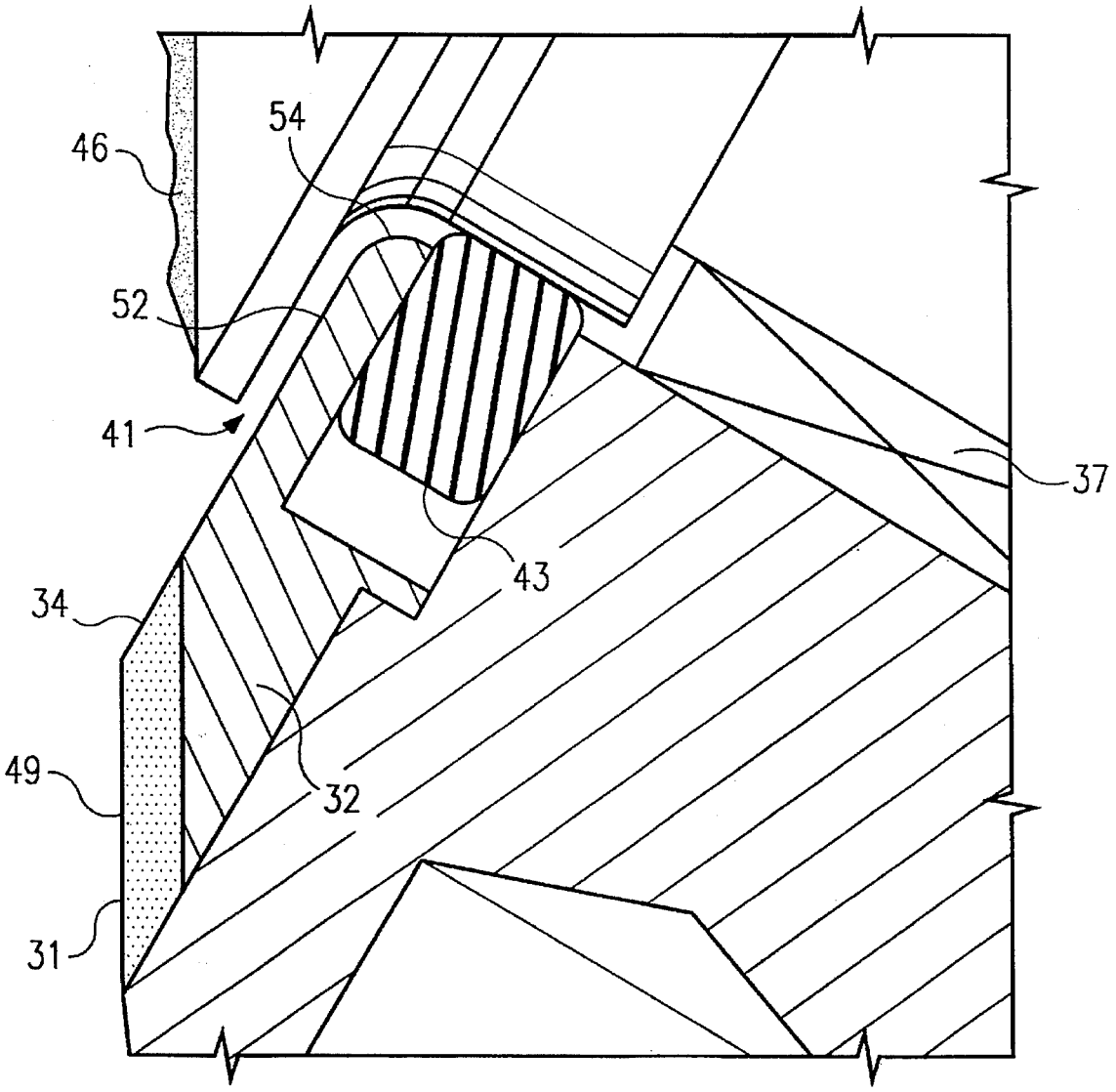
FIG. 2A is an enlarged drawing of the rotary cone cutter illustrated in FIG. 2.
Figure 3:
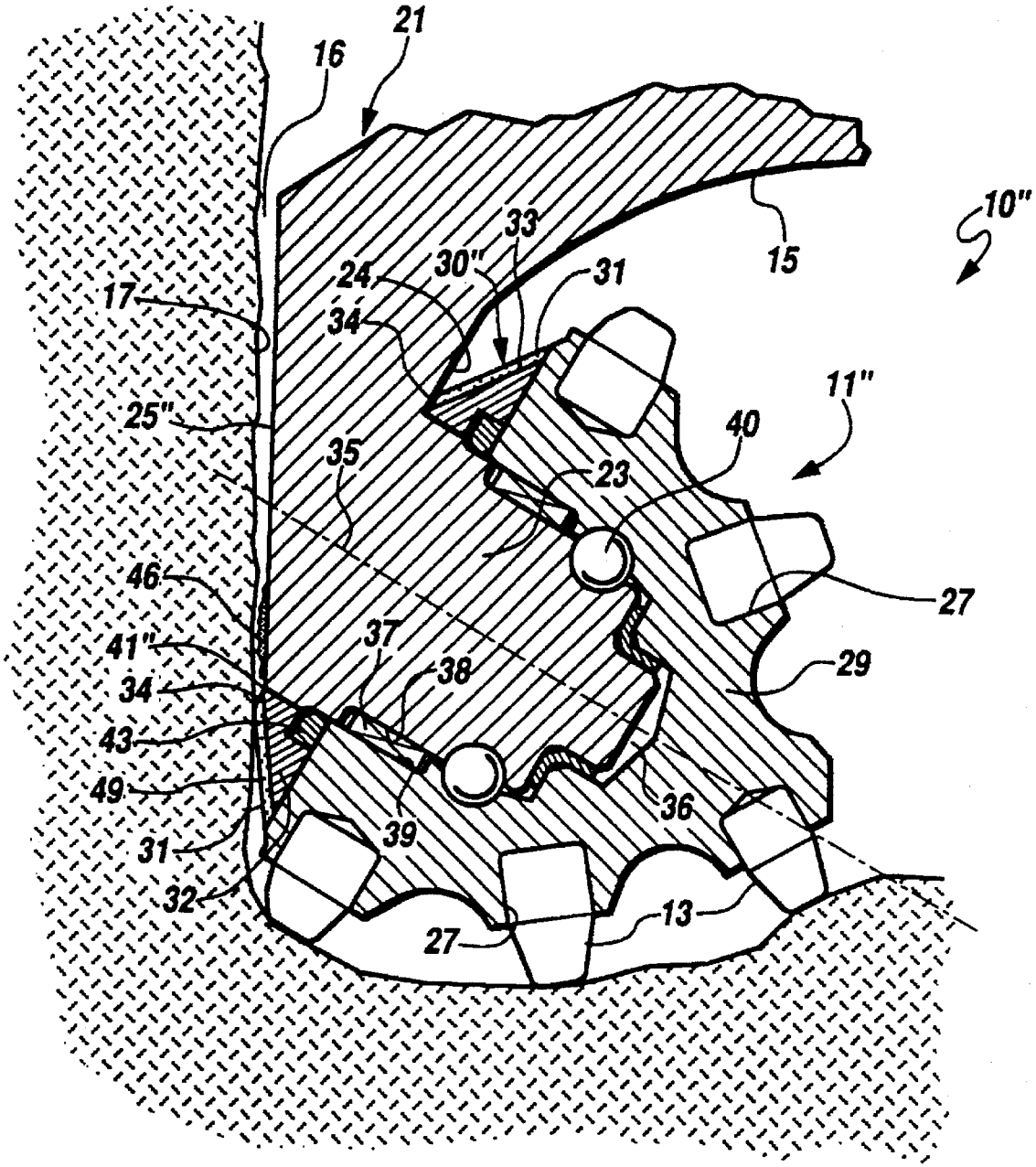
FIG. 3 is a drawing partially in section and partially in elevation with portions broken away showing a rotary cone cutter incorporating an alternative embodiment of the present invention in drilling engagement with the bottom of a borehole.

FIGS. 2 and 3 show alternative embodiments of the present invention represented by roller cone cutters 11 and 11" which may be satisfactorily use with a rotary drill bit such as shown in FIG. 1. Drill bit 10 of FIGS. 1 and 2 is essentially equivalent in structure and operation to drill bit 10" of FIG. 3, except for modifications to shirttail surface 25" and cone cutter 11". The dimensions of base portion or backface ring 30" have also been modified to accommodate shorter shirttail surface 25" shown in FIG. 3. These modifications will be described later in more detail.

As shown in FIG. 2, inserts 13 are mounted within sockets 27 formed in a conically-shaped shell or tip 29 of cutter 11. Various types of inserts and compacts may be used with tip 29 depending upon the intended application for the resulting drill bit. For example, oval shaped compacts (not shown) may be used to provide longer service life with less wear. Also, tip 29 could be formed with one or more rows of teeth (not shown).

Base portion 30 of cutter 11 includes grooves 12 and is frustoconical in shape, but angled in a direction opposite the angle of tip 29 on the outer surface thereof. Base 30 also includes a frustoconically-shaped outer portion 33 with backface 31 formed on the outer surface thereof and an end portion 34 extending radially relative to central axis 35 of spindle 23. Base 30 and tip 29 cooperate to from composite cone cutter 11. Base portion 30 may also be referred to as a "backface ring".

Opening inwardly of end portion 34 is a generally cylindrical cavity 36 for receiving spindle 23. A suitable bearing 37 is mounted on spindle 23 and engages between a bearing wall 39 of cavity 36 and an annular bearing surface 38 on spindle 23. A conventional ball retaining system 40 secures cutter 11 to spindle 23.

FIG. 2 is an enlarged view in section and elevation of support arm 21 and its associated spindle 23 with composite cutter cone 11 mounted thereon. A gap 41 is formed between the interior of cylindrical cavity 36 and adjacent inside surface 24 of supporting arm 21 and/or the exterior portions of spindle 23. The tip of shirttail surface 25 cooperates with end portion 34 of base portion 30 to partially define first section 52 of gap 41. Second section 54 of gap 41 is defined by the interior of cavity 36 and the exterior of spindle 23. First section 52 of gap 41 lies in a plane that is generally perpendicular to spindle axis 35. Second section 54 of gap 41 extends approximately parallel with spindle axis 35. Thus, gap 41 includes first section 52 which is substantially perpendicular to second section 54.

An elastomeric seal 43 is disposed within gap 41 between spindle 23 and the interior of cavity 36 to block the infiltration of well fluids and debris through gap 41. Seal 43 is located adjacent the juncture of spindle 23 with support arm 21. Seal 43 both retains lubricants within bearing 37 and protects against the infiltration of debris through gap 41 to the space between the relatively-rotating bearing surfaces 38 and 39 of spindle 23 and cutter 11. Seal 43 protects the associated bearing 37 from loss of lubricants and such debris, and thus prolongs the life of drill bit 10.

Gap 41 includes an opening located adjacent outside surface or shirttail 25 and contiguous with the bottom edge of arm 21, and is thus open to fluid communication with borehole annulus 16. It is important that the width of gap 41 be kept relatively small and the length of gap 41 between its opening to annulus 16 and seal 43 be kept relatively long so as to reduce the infiltration of debris that may wear against seal 43 as bit 10 rotates.

The dual-section structure of gap 41 also inhibits debris from entering between bearing surfaces 38 and 39. Typically, debris entering first section 52 will have insufficient momentum to flow into second section 54. Such debris will simply fall from section 52 back into annulus 16 instead of wearing on seal 43. Thus, both the positioning of the opening of gap 41 (adjacent to surface 25 and contiguous with the bottom edge of arm 21) and its dual-section structure provide seal 43 with debris-wear protection. Backface 31 preferably extends a sufficient distance X beyond the edge of shirttail surface 25 to deflect the drilling fluid away from the opening of gap 41 which further prevents fluid-borne debris from contacting seal 43 and entering between bearing surfaces 38 and 39 via gap 41.

In accordance with another aspect of the present invention as best shown in FIG. 3, cutter 11" and bit support arm 21 are uniquely constructed so that base portion 30" of cutter 11" interfits with spindle 23 which allows gap 41" to extend throughout its length in a direction substantially parallel to spindle axis 35. Specifically, gap 41" includes an outer cylindrical segment which intersects with shirttail surface 25" and opens upwardly and outwardly from between spindle 23 and cutter 11" into borehole annulus 16. As a result, hard metal surfaces may be positioned to better protect gap 41 against erosion, and the service life of seal 43 is lengthened, particularly over those prior art arrangements having a shirttail tip with an underside that over time, may be exposed by erosion to borehole debris.

As shown in both FIGS. 2 and 3, the bottom of shirttail 25 and 25" adjacent respectively to gaps 41 and 41" may be covered with a layer 46 of conventional hardfacing material to help protect against erosion widening gap 41 by eroding arm 21. A preferred hardfacing material comprises tungsten carbide particles dispersed within a cobalt, nickel, or iron-based alloy matrix, and may be applied using well known fusion welding processes.

As shown in FIG. 2 additional protection against erosion may be achieved by spacing outer portion 33 and backface 31 of cutter 11 radially outward a distance X from hardfacing layer 46. Distance X allows backface 31 to deflect the flow of drilling fluid enough to prevent the fluid from flowing directly into the opening of gap 41. Distance X is a function of the borehole diameter and the bit type (no seal, seal, or double seal), and may range from 1/16" to 3/16". For one embodiment of the present invention, X is approximately 1/8".

For enhanced wearability of backface 31 on the cone side of gap 41, backface 31 is either provided with a hard material covering or made from hard metal. As will be explained later in more detail, the present invention allows forming backface 31 from a wide variety of hard materials. Backface 31 is preferably harder than the hardfacing material comprising layer 46, and is attached to outer portion 33 of base 30 without use of a filler material. Specifically, backface 31 may comprise a composition of material including tungsten carbide particles surrounded by a matrix of a copper, nickel, iron, or cobalt based alloy that is applied directly over substantially the entire outer portion 33. Acceptable alternative hardfacing materials include carbides, nitrides, borides, carbonitrides, silicides of tungsten, niobium, vanadium, molybdenum, silicon, titanium, tantalum, hafnium, zirconium, chromium or boron, diamond, diamond composites, carbon nitride, and mixtures thereof. For some application, tungsten carbide particles with the size range given in Table 1 may be used to form backface 31.

In accordance with an important aspect of the present invention as illustrated in the embodiments of both FIGS. 2 and 3, cutters 11 and 11" each have a composite cone body with respective bases 30 and 30" formed separately from tip 29. Bases 30 and 30" may include a nonheat-treatable hard metal component having a higher degree of hardness than found in prior rotary cone cutters. In contrast, conical tip 29 may be made of a conventional heat-treated steel. With this construction, cone backface 31 is better able to withstand both erosion and abrasive wear, thus not only providing enhanced protection of seal 43, but also serving to better maintain the gage diameter of borehole wall 17, particularly when drilling a deviated or horizontal borehole.

An important feature of the present invention is that tip 29 may be manufactured from any hardenable steel or other high-strength engineering alloy which has the desired strength, toughness, and wear resistance to withstand the rigors of the specific downhole application. In an exemplary embodiment, tip 29 is manufactured from a 9315 steel having a core hardness in the heat-treated condition of approximately HRC 30 to 45, and having an ultimate tensile strength of 950 to 1480 MPa (138 to 215 ksi). Other portions of cutter 11, such as precision bearing surfaces 39, may also be formed from this 9315 steel. In producing tip 29, the alloy is heat-treated and quenched in a conventional and well known manner to give tip 29 the desired degree of hardness.

An equally important feature of the present invention is that base portions 30 and 30" may be designed and fabricated from materials which enhance the service life of respective roller cone cutter 11 and 11" without limiting the performance of associated tip 29. In the illustrated embodiments of FIGS. 2 and 3, base 30 and 30" comprise a low-alloy steel core 32 onto which is affixed continuous layer or coating 49 of hard metal. A low-alloy steel typically has between approximately 2 and 10 weight percent alloy content. Core 32 may also be referred to as a "matrix ring." Core 32 is preferably a ring-shaped piece of the same material composition as tip 29, but of less expensive steel alloy which is not quench hardenable such as low carbon steel. In affixing layer 49, the exterior of steel core 32 is machined to size to receive the desired coating, and placed into a prepared mold (not shown) whose cavity is shaped to provide the desired coating thickness for layer 49 and frustoconical shape for outer portion 33.

For some applications, matrix ring or core 32 is an infiltrant alloy comprising Mn 25 weight percent, Ni 15 weight percent, Zn 9 weight percent, and Cu 51 weight percent. This alloy has good melt and flow characteristics, and good wettability for both tungsten carbide and steel. A typical hardfacing layer 49 may comprise between 20% and 40% infiltrant alloy by volume.

Techniques for the application of hardfacing layer 49 are well known in the art. One technique is an atomic hydrogen or oxyfuel welding process using a tube material containing ceramic particles in a Ni, Co, Cu or Fe based matrix. A second technique is the Thermal Spray or Plasma Transfer Arc process using powders containing ceramic particles in a Ni, Co, Cu or Fe based matrix. This technique is discussed in U.S. Pat. No. 4,938,991. Both the first and second techniques may be performed either by hand or by robotic welder. A third technique is disclosed in U.S. Pat. No. 3,800,891 (see columns 7, 8 and 9).

Alternatively, hardfacing layer 49 may be applied by a slurry casting process in which hard particles, such as the alternative hardfacing materials described for the preferred embodiment, are mixed with a molten bath of ferrous alloy. Alternatively, the molten bath may be of a nickel, cobalt, or copper based alloy. This mixture is poured into a mold and solidifies to form base portion 30. Grooves 12 may be molded during the application of hard facing layer 49, or may be cut into layer 49 after it has been applied to matrix ring 32.

The prepared mold for one embodiment is milled or turned from graphite. Each internal surface that will contact steel core 32 is painted with brazing stop off, such as Wall Colmonoy's Green Stop Off® paint. Also painted are the surfaces of steel core 32 that will not be coated with hardfacing layer 49. Preferably, the mold is designed so that the thermal expansion of steel core 32 will not stress the fragile graphite mold parts.

Steel core 32 is assembled within the painted mold. The hard particles which form hardfacing layer 49 are then distributed within the mold cavity. TABLE 1 shows the sizes and distribution of the hard particles for the preferred embodiment.

TABLE I

| U.S. Mesh | Weight % |
|---|---|
| +80 | 0–3 |
| −80 +120 | 10–18 |
| −120 +170 | 15–22 |
| −170 +230 | 16–25 |
| −230 +325 | 10–18 |
| −325 | 28–36 |

Next, a vibration is applied to the mold to compact the layer of loose particles within the mold cavity. The infiltrant alloy is then placed in the material distribution basin above the hard particle layer in the cavity. If the infiltration operation is performed in an air furnace, powdered flux is added to protect the alloy. If the operation is performed in a vacuum or protective atmosphere, flux is not required.

In utilizing the mold, tungsten carbide powder or another suitable material is dispersed within the cavity to fill it, and an infiltrant alloy is positioned relative to the mold. Then the infiltrant alloy and the mold are heated within a furnace to a temperature at which the alloy melts and completely infiltrates the mold cavity, causing the carbide particles to bond together and to steel core 32.

Alternatively, base 30 can be made as a casting of composite material comprised of hard particles, such as Boron Carbide ($B_4C$), Silicon Nitride ($Si_3N_4$), or Silicon Carbide (SiC), in a tough ferrous matrix such as a high strength, low alloy steel, or precipitation hardened stainless steel. In the form of fibers or powders, these particles can reinforce such a matrix. This matrix may be formed either by mixing the particles with the molten alloy and casting the resultant slurry, or by making a preform of the particles and allowing the molten alloy to infiltrate the preform. Base 30 may be attached to tip 29 by inertia welding or similar techniques to form composite rotary cone cutter 11.

Once both base 30 (made in a manner other than the above-described composite-material casting process) and tip 29 are made, these two separate parts are joined together in a manner which is substantially non-destructive of the desirable characteristics of each. Preferably, they are joined together along a weld line 50 (FIG. 2) utilizing the process of inertia welding wherein one part is held rotationally stationary while the other is rotated at a predetermined speed that generates sufficient localized frictional heat to melt and instantaneously weld the parts together without use of a filler. This process employs a conventional inertia welding machine that is configured to allow variation of the rotating mass within the limitations of the machine's mass-rotating capacity and to rotate the mass at a controllable and reproducible rate. Once the rotating part is at the predetermined rotational speed, the parts are brought into contact with a predetermined forging force sufficient to completely deform a premachined circumferential ridge which is 0.191 inches wide and 0.075 inches high. The rotational speed is empirically determined with test parts of the same size, alloy, and prejoining condition. The complete deformation allows two planar facing surfaces on the parts being joined to come into contact.

In one example, base 30 having a volume of 4.722 cubic inches and a weight of 1.336 lbs. was successfully joined to a tip 29 having a volume of 16.69 cubic inches and a weight of 4.723 lbs. using a 44,000 lb. axial load and a rotational speed of 2200 rpm.

As best shown in FIG. 2, rotary cone cutter 11 may be formed by inertially welding base 30 with tip 29. A circumferential flange or ridge 112 may be provided on the interior of base 30 to engage with recess 114 formed in the adjacent portion of tip 29. Circumferential flange 112 cooperates with recess 114 to establish the desired alignment of base 30 with tip 29 during the inertial welding process. During later steps in the assembly of rotary cone cutter 11, elastomeric seal 43 may be disposed within recess 114.

Figure 4B:
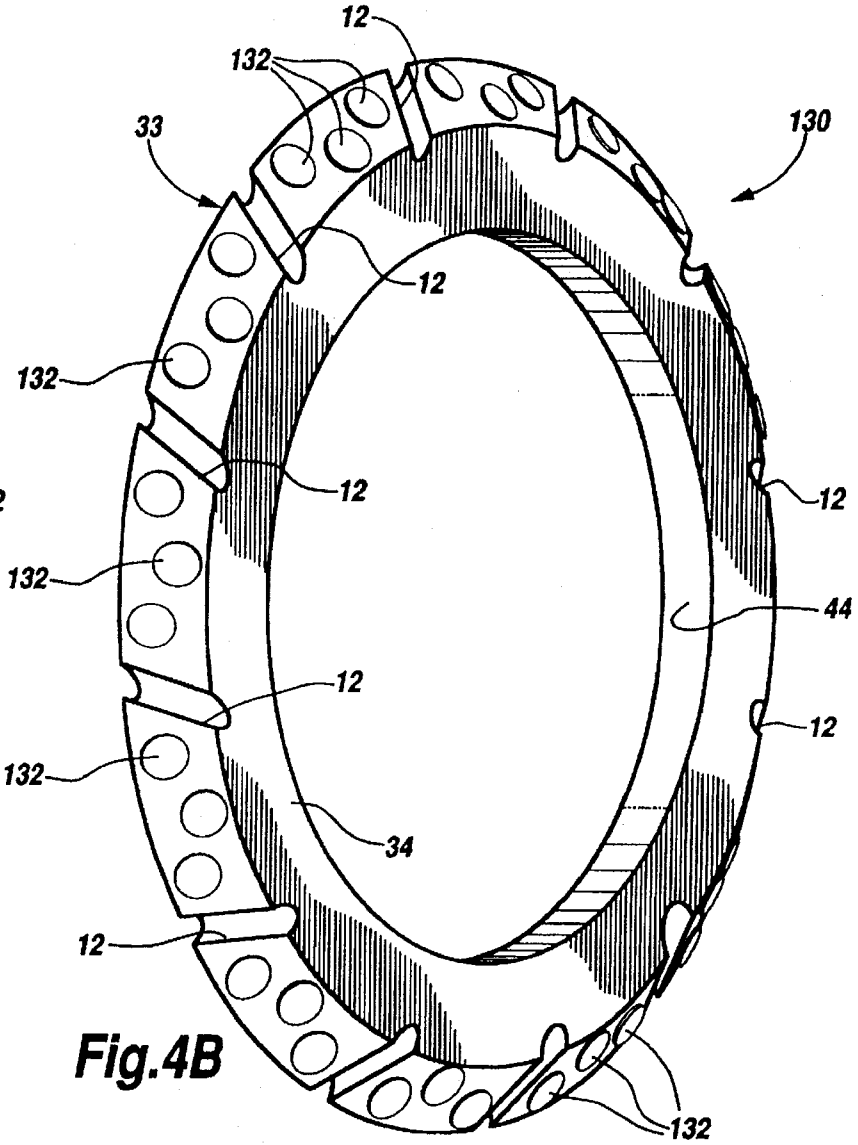
FIG. 4B is an enlarged isometric drawing of a backface ring incorporating another embodiment of the present invention satisfactory for use with the rotary cone cutters of FIGS. 1 and 2.
Figure 4A:
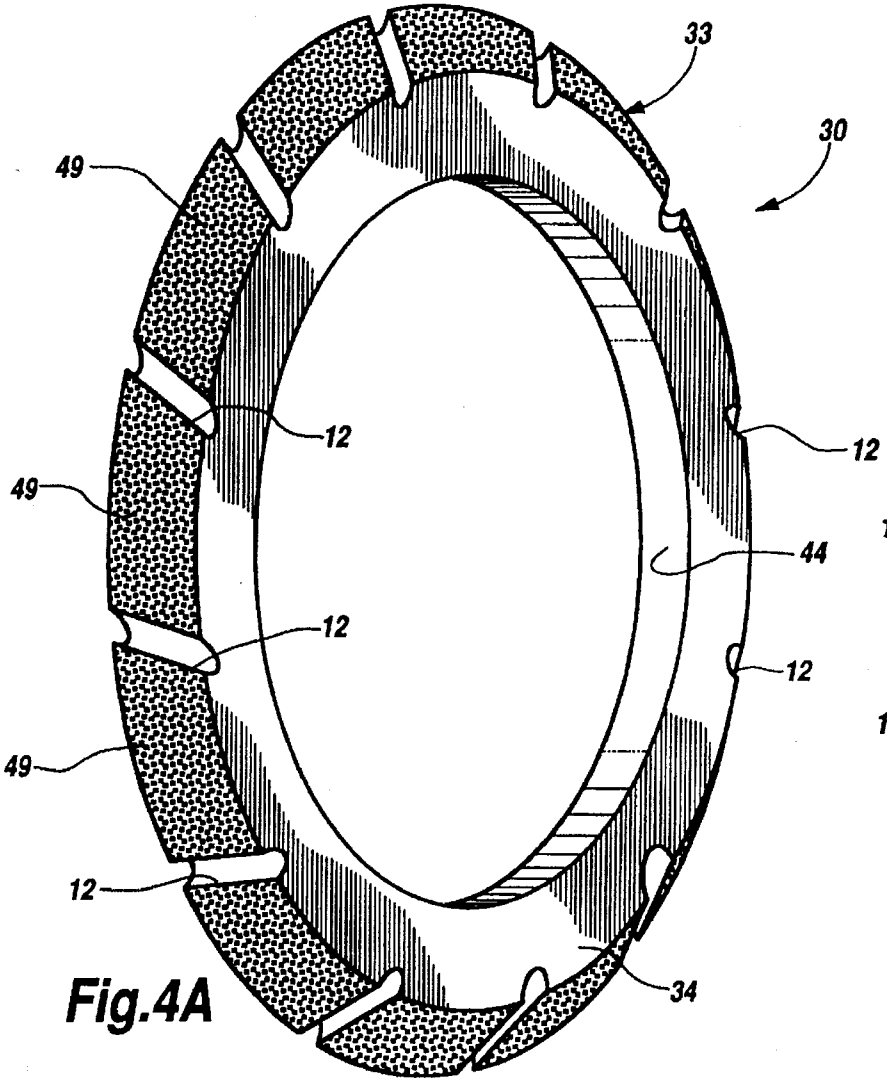
FIG. 4A is an enlarged isometric drawing of a backface ring incorporating one embodiment of the present invention satisfactory for use with the rotary cone cutters of FIGS. 1 and 2.

FIGS. 4A–D show base portion 30, 130, 230 and 330 respectively which may be coupled with tip 29 as previously described to provide a composite cone cutter incorporating various alternative embodiments of the present invention. An important benefit of the present invention includes the ability to use same tip 29 with various base portions or backface rings. FIG. 4A is an enlarged drawing showing base portion or backface ring 30 as previously described with respect to composite cone cutter 11. Backface ring 30 includes opening 44 which is sized to be compatible with cavity 36 and to allow installation of spindle 23 within cavity 36 of associated cone cutter 11. Layer 49 of the desired hard facing material is preferably disposed on the exterior of outer portion 33 to form backface 31.

Backface ring 130 incorporating an alternative embodiment of the present invention is shown in FIG. 4B. Outer portion 33 of backface ring 130 includes a plurality of generally cylindrical shaped inserts 132. For one application, inserts 132 have a thickness or height of approximately 0.080". The thickness of inserts 132 is limited in part by the thickness of the associated matrix ring or steel core 32. Inserts 132 may be formed from various types of material such as sintered carbide, thermally stable diamonds, diamond particles, or any of the other materials used to form layer 49.

Figure 4D:
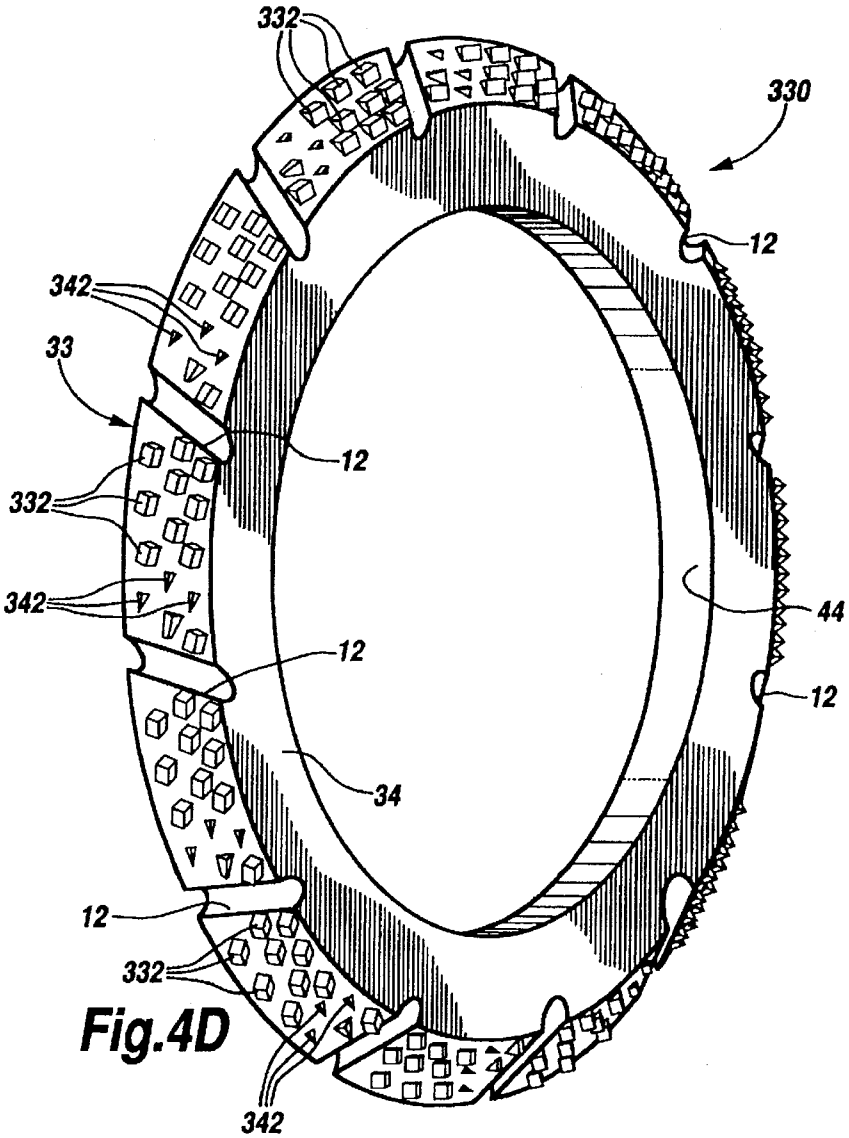
FIG. 4D is an enlarged isometric drawing of a backface ring incorporating an alternative embodiment of the present invention satisfactory for use with the rotary cone cutters of FIGS. 1 and 2.
Figure 4C:
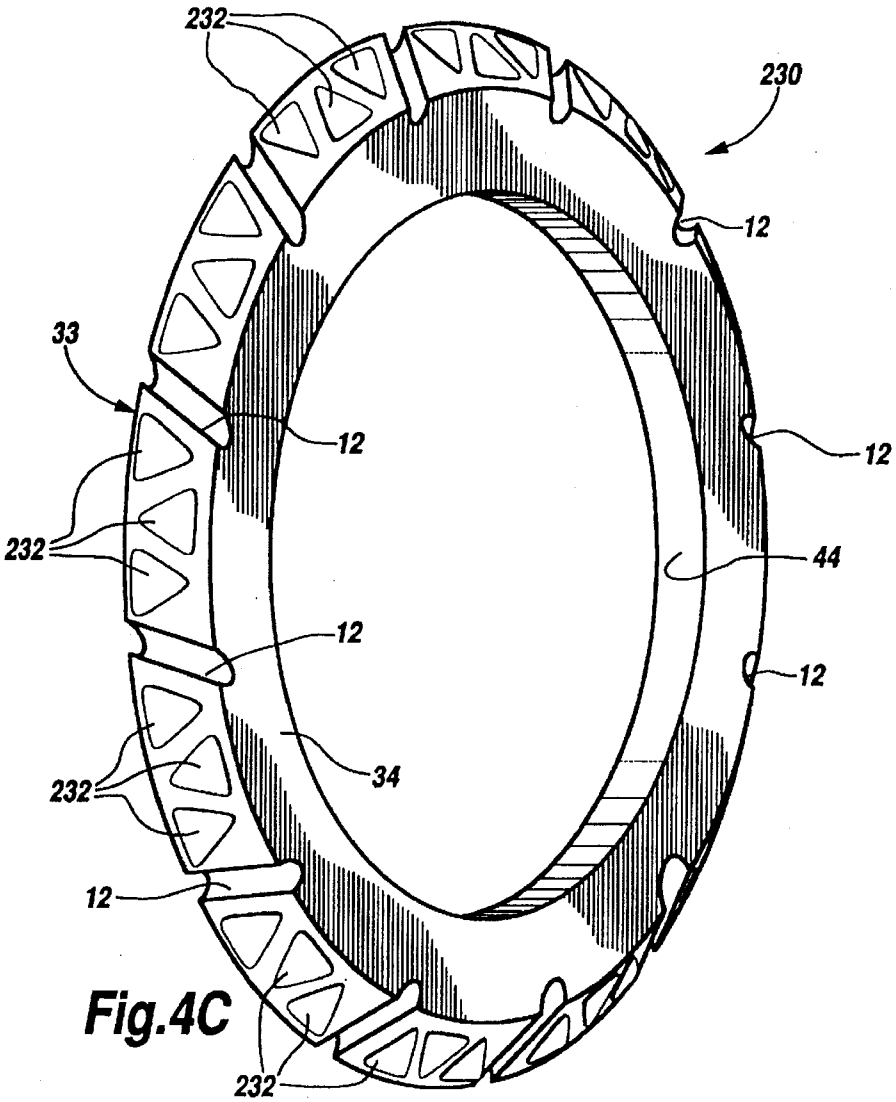
FIG. 4C is an enlarged isometric drawing of a backface ring incorporating another embodiment of the present invention satisfactory for use with the rotary cone cutters of FIGS. 1 and 2.

Backface ring 230 incorporating another alternative embodiment of the present invention is shown in FIG. 4C. A plurality of inserts 232 are provided in outer portion 33 of backface ring 230. Inserts 232 have a generally triangular cross-section as compared to the circular cross-section of inserts 132. Otherwise, inserts 232 may be fabricated from the same materials as previously described with respect to insert 132.

Backface ring 330 incorporating still another alternative embodiment of the present invention is shown in FIG. 4D. A plurality of inserts 332 are provided in outer portion 33 of backface ring 330. Inserts 332 may be natural diamonds and/or artificial diamonds which have been cast as an integral part of backface ring 330. Inserts 342 represent smaller diamonds or diamond chips cast as an integral part of backface ring 330. The present invention allows varying the size, location, and number of diamonds or diamond chips used to form outer portion 33 depending upon the intended use for the resulting rotary drill bit.

Although the present invention and its advantages have been described in detail, it should be understood that various changes, substitutions and alterations can be made therein without departing from the spirit and scope of the invention as defined by the appended claims.

What is claimed is:

1. A method of manufacturing a rotary cone drill bit with a plurality of roller cone cutters with each cutter having a generally conical configuration and a composite cone body having a base with a backface formed of a hard material and a tip comprising the steps of:

constructing said base;

constructing said tip;

depositing a desired coating thickness of powdered metal on a low alloy steel core;

heating said steel core and said powdered metal together to bond said powdered metal with said steel core; and joining together said previously constructed tip and base by inertial welding.

2. A method of manufacturing a rotary cone drill bit with a plurality of roller cone cutters with each cutter having a generally conical configuration and a composite cone body having a base with a backface formed of a hard material and a tip comprising the steps of:

constructing said base;

constructing said tip;

shaping a portion of a central core of steel to receive a layer of hard metal material;

forming said layer of hard metal material on said central core within said shaped portion; and joining together said previously constructed tip and base by inertial welding.

3. A method of manufacturing a rotary cone drill bit with a plurality of roller cone cutters with each cutter having a generally conical configuration and a composite cone body having a base with a backface formed of a hard material and a tip comprising the steps of:

constructing said base;

constructing said tip;

forming a hard layer of metal material on said base;

forming a plurality of radial grooves in said layer of hard metal material; and joining together said previously constructed tip and base by inertial welding.

4. A method of manufacturing a rotary cone drill bit having a plurality of roller cone cutters comprising the steps of:

forming each of said roller cone cutters from a cone body having a generally conical configuration including a base and a tip;

constructing said base with a backface formed from a hard material selected from the group consisting of tungsten carbide, nitrides, borides, carbon nitride, silicides of tungsten, niobium, vanadium, molybdenum, silicon, titanium, tantalum, hafnium, zirconium, chromium, boron, diamonds, diamond particles, or mixtures thereof;

constructing said tip; and joining together said previously constructed tip and base by inertial welding.

5. The method of claim 4 wherein constructing said base further comprises the steps of:

depositing a desired coating thickness of powdered metal on a low alloy steel ring; and heating said steel core and said powdered metal together to bond said powdered metal with said steel core.

6. The method of claim 4 further comprising the steps of:

shaping a portion of a steel core to receive a layer of hard metal material; and forming said layer of hard metal material on said core within said shaped portion.

7. The method of claim 6 further comprising the step of forming a plurality of radial grooves in said layer of hard metal material.

8. The method of claim 4 further comprising the step of forming a plurality of radial grooves in the backface.

9. The method of claim 4 wherein constructing the base further comprises the steps of:

forming the base with an opening extending therethrough and an outer portion having a frustoconical shape around said opening; and placing a plurality of inserts in the outer portion of the base.

10. The method of claim 9 further comprising the step of forming the inserts from material selected from the group consisting of sintered carbide, thermally stable diamonds, diamond particles, natural diamonds, or artificial diamonds.

11. A method of manufacturing a roller cone cutter for a rotary cone drill bit comprising the steps of:

forming said roller cone cutter from a cone body having a generally conical configuration including a base and a tip;

constructing said base with a backface formed in part with a nonheat-treatable hard metal component;

constructing said tip in part from conventional heat-treated steel; and joining together said previously constructed tip and base.

12. The method of claim 11 wherein constructing said base further comprises the steps of:

depositing a desired coating thickness of powdered metal on a low alloy steel ring; and heating said steel core and said powdered metal together to bond said powdered metal with said steel core.

13. The method of claim 11 further comprising the steps of:

shaping a portion of a steel core to receive a layer of hard metal material; and forming said layer of hard metal material on said core within said shaped portion.

14. The method of claim 13 further comprising the step of forming a plurality of radial grooves in said layer of hard metal material.

15. The method of claim 11 further comprising the step of forming said backface from hard material selected from the group consisting of tungsten carbide, nitrides, borides, silicides of tungsten, niobium, vanadium, molybdenum, silicon, titanium, tantalum, hafnium, zirconium, chromium, boron, diamonds, diamond particles, carbon nitrides, or mixtures thereof.

16. The method of claim 4 further comprising joining said previously constructed tip and base by inertial welding.

17. The method of claim 11 wherein constructing the base further comprises the steps of:

placing a matrix ring in a mold having a cavity shaped to correspond with a desired frustoconical outer portion for the base;

filling the mold cavity with a hard metal powder; and heating the mold and the matrix ring to bond the hard metal powder with the matrix ring to form the outer portion of the base.

18. The method of claim 17 further comprising the step of filling the mold cavity with tungsten carbide particles.

19. The method of claim 11 wherein constructing the base further comprises the step of casting composite materials selected from a first group consisting of boron carbide, silicon nitride or silicon carbide and a second group consisting of high strength, low alloy steel or precipitation hardened stainless steel.

* * * * *